US009362651B2

(12) United States Patent
Yamanaka et al.

(10) Patent No.: US 9,362,651 B2
(45) Date of Patent: Jun. 7, 2016

(54) LOCKING STRUCTURE OF TERMINAL FITTING AND BULB SOCKET

(71) Applicant: Yazaki Corporation, Tokyo (JP)

(72) Inventors: Hideki Yamanaka, Makinohara (JP); Shinji Yamada, Yokohama (JP); Hirohito Toriyama, Yokohama (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/566,089

(22) Filed: Dec. 10, 2014

(65) Prior Publication Data

US 2015/0162694 A1 Jun. 11, 2015

(30) Foreign Application Priority Data

Dec. 11, 2013 (JP) ..... 2013-255870

(51) Int. Cl.

| | |
|---|---|
| ***H01R 13/432*** | (2006.01) |
| *H01R 13/627* | (2006.01) |
| *H01R 13/6582* | (2011.01) |
| *H01R 33/06* | (2006.01) |
| *H01R 24/60* | (2011.01) |
| *H01R 24/62* | (2011.01) |
| *H01R 24/76* | (2011.01) |
| *H01R 13/717* | (2006.01) |
| *F21Y 111/00* | (2016.01) |
| *F21Y 101/02* | (2006.01) |
| *H01R 33/09* | (2006.01) |

(52) U.S. Cl.

CPC ..... *H01R 13/432* (2013.01); *F21Y 2101/02* (2013.01); *F21Y 2111/005* (2013.01); *H01R 13/6271* (2013.01); *H01R 13/6582* (2013.01); *H01R 13/7175* (2013.01); *H01R 24/60* (2013.01); *H01R 24/62* (2013.01); *H01R 24/76* (2013.01); *H01R 33/06* (2013.01); *H01R 33/09* (2013.01); *H01R 2201/26* (2013.01)

(58) Field of Classification Search

CPC ..... H01R 24/60; H01R 24/62; H01R 24/76; H01R 13/6582; H01R 13/6271; H01R 13/7175; H01R 33/06; H01R 2201/26; F21Y 2101/02; F21Y 2111/005

USPC ..... 439/660, 746, 872; 362/657

See application file for complete search history.

(56) References Cited

U.S. PATENT DOCUMENTS

2014/0334184 A1* 11/2014 Yamanaka ..... B60Q 3/0203 362/657

FOREIGN PATENT DOCUMENTS

| | | | |
|---|---|---|---|
| JP | 2013-152898 A | | 8/2013 |
| JP | 2013152898 A | * | 8/2013 |
| WO | 2013/111581 A1 | | 8/2013 |

* cited by examiner

*Primary Examiner* — Abdullah Riyami
*Assistant Examiner* — Justin Kratt
(74) *Attorney, Agent, or Firm* — Sughrue Mion, PLLC

(57) ABSTRACT

A locking structure includes a terminal fitting and a terminal containing portion that holds and contains the terminal fitting so that the terminal fitting is electrically connected to a connection counterpart in a condition that at least part of the connection counterpart is inserted in the terminal containing portion. A first lock projection which is elastically deformable and is provided on the terminal fitting is locked on a second lock projection which is provided on the terminal containing portion. The at least part of the connection counterpart inserted in the terminal containing portion restricts elastic deformation of the first lock projection in a direction in which the first lock projection is unlocked from the second lock projection.

7 Claims, 26 Drawing Sheets

LOCKING STRUCTURE OF TERMINAL FITTING AND BULB SOCKET

BACKGROUND

The present disclosure relates to a locking structure of a terminal fitting in which the terminal fitting is locked in a terminal containing portion by a terminal-side lock projection of the terminal fitting, as well as to a bulb socket having the lock structure.

Among related locking structures of a terminal fitting in which a terminal fitting is held by and contained in a terminal containing portion of a connector, a bulb socket, or the like is one in which a terminal-side lock projection of a terminal fitting is locked on a holding-side lock portion of a terminal containing portion as a result of elastic recovery of the terminal-side lock projection at a lock position of the holding-side lock portion.

For example, JP-A-2013-152898 discloses a bulb socket in which a terminal fitting is held by and contained in a terminal containing portion provided in a socket main body by locking, in the terminal containing portion, a lock piece (terminal-side lock projection) formed by cutting and erecting a portion of the terminal fitting.

However, the locking structure of a terminal fitting disclosed in JP-A-2013-152898 has the following problem. The lock piece (terminal-side lock projection) is locked on a projection (holding-side lock portion) provided in the terminal containing portion. Therefore, as the lock piece is moved toward a lock position, it needs to be deformed to a large extent in the direction opposite to its projection direction to climb over the projection (holding-side lock portion). As a result, its resilience that is necessary for recovery in the projection direction may be decreased, possibly resulting in lowering of the locking force.

SUMMARY

The present disclosure has been made in the above circumstances, and an object of the present disclosure is therefore to provide a locking structure of a terminal fitting which can prevent lowering of the force for locking of the terminal fitting, as well as a bulb socket having the lock structure.

To solve the above problem and attain the above object, the present disclosure provides, a locking structure of a terminal fitting, comprising:

a terminal fitting; and a terminal containing portion that holds and contains the terminal fitting so that the terminal fitting is electrically connected to a connection counterpart in a condition that at least part (insertion portion) of the connection counterpart is inserted in the terminal containing portion, wherein a first lock projection which is elastically deformable and is provided on the terminal fitting is locked on a second lock projection which is provided on the terminal containing portion; and wherein the at least part of the connection counterpart inserted in the terminal containing portion restricts elastic deformation of the first lock projection in a direction in which the first lock projection is unlocked from the second lock projection.

By the above configuration, the insertion portion of the connection counterpart restricts elastic deformation of the first lock projection (which is provided in the terminal fitting so as to be capable of elastic deformation) in the direction in which the first lock projection is unlocked from the second lock projection. As a result, lowering of the force for locking of the terminal fitting can be prevented.

For example, before insertion of the at least part of the connection counterpart into the terminal containing portion, the first lock projection is in an elastically neutral state and projects toward an insertion space in the terminal containing portion in which the at least part of the connection counterpart is to be inserted, and when the at least part of the connection counterpart is inserted in the terminal containing portion, the at least part of the connection counterpart pushes the first lock projection which has been located in the insertion space toward the second lock projection so that the first lock projection is locked on the second lock projection.

By the above configuration, the first lock projection being in an elastically neutral state projects to the insertion space in the terminal containing portion. When the insertion portion is inserted in the terminal containing portion, the insertion portion pushes the first lock projection (of the terminal fitting located at the lock position) to project to a side of the second lock projection. Therefore, the first lock projection does not come into contact with the second lock projection and deform it elastically before the terminal fitting reaches to the lock position. This prevents reduction of the resilience of the first lock projection. As a result, the locking force can be increased.

For example, the terminal fitting has a press-fit portion which is held by the terminal containing portion, and the terminal containing portion has a terminal press-fit holding portion which is press-fitted with the press-fit portion and thereby holds the terminal fitting at the lock position.

By the above configuration, the terminal fitting can be held at the lock position even before insertion of the insertion portion.

According to the present invention, there is also provided a bulb socket for supplying power to a bulb as a light source, comprising:

the locking structure of the terminal fitting described above, wherein the connection counterpart is the bulb; and wherein the terminal containing portion is provided in a socket main body of the bulb socket By the above configuration, the insertion portion of the connection counterpart restricts elastic deformation of the first lock projection (which is provided in the terminal fitting so as to be capable of elastic deformation) in the direction in which the first lock projection is unlocked from the second lock projection. As a result, lowering of the force for locking of the terminal fitting can be prevented.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Locking structures of terminal fittings and bulb sockets according to preferred embodiments of the present disclosure will be hereinafter described in detail with reference to the drawings.

[Embodiment 1]

Figure 1:
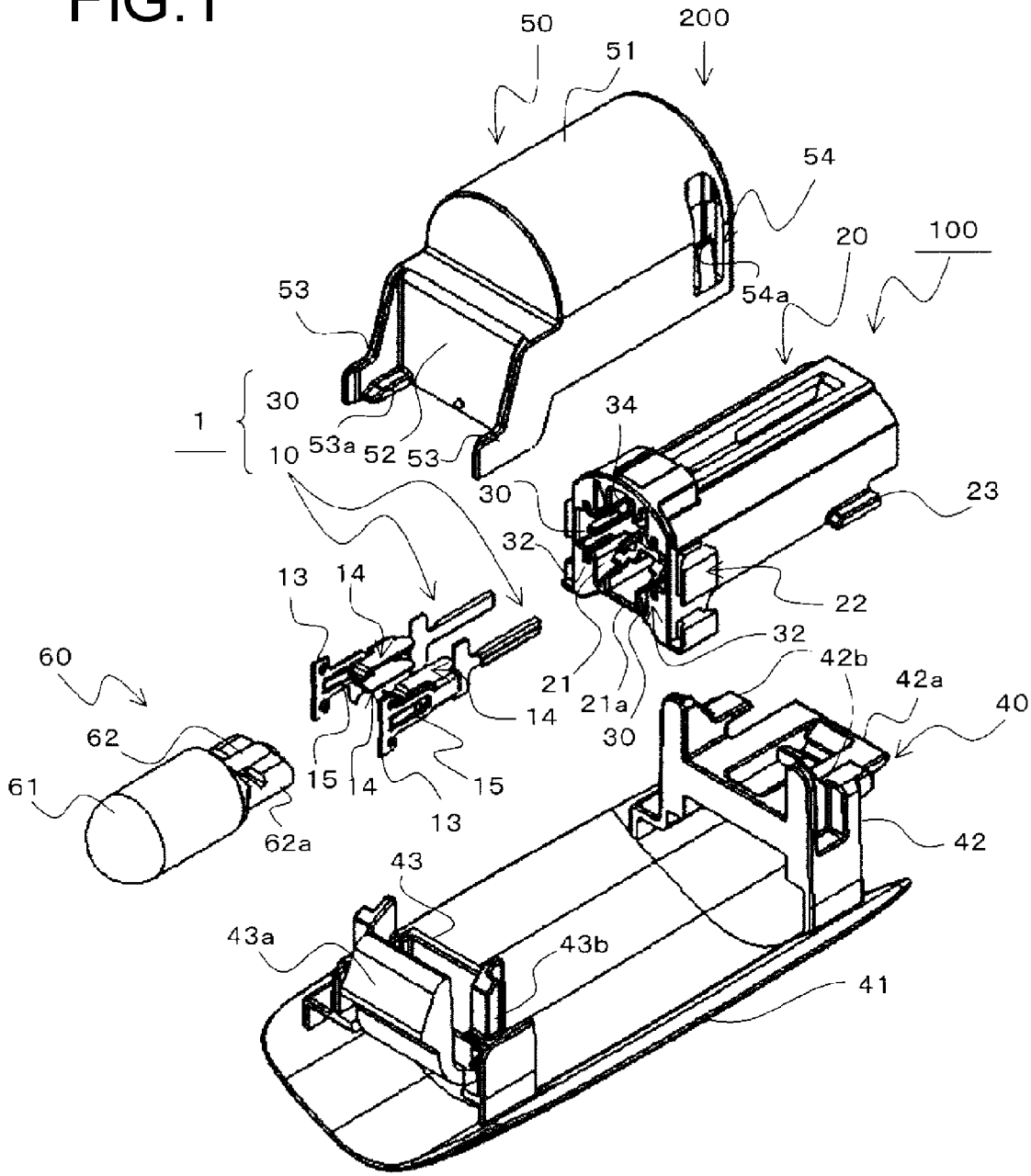
FIG. 1 is an exploded perspective view of an illumination device which incorporates a bulb socket that includes a locking structure of terminal fittings according to a first embodiment of the present disclosure.
Figure 2A:
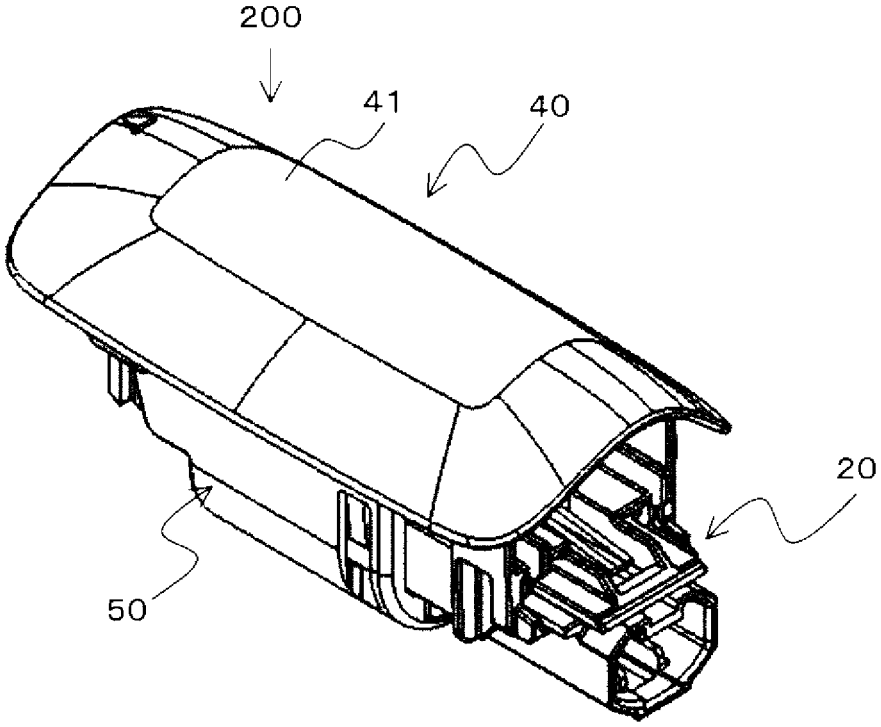
FIG. 2A is a perspective view of the illumination device as viewed from the side of a translucent lens.
Figure 2B:
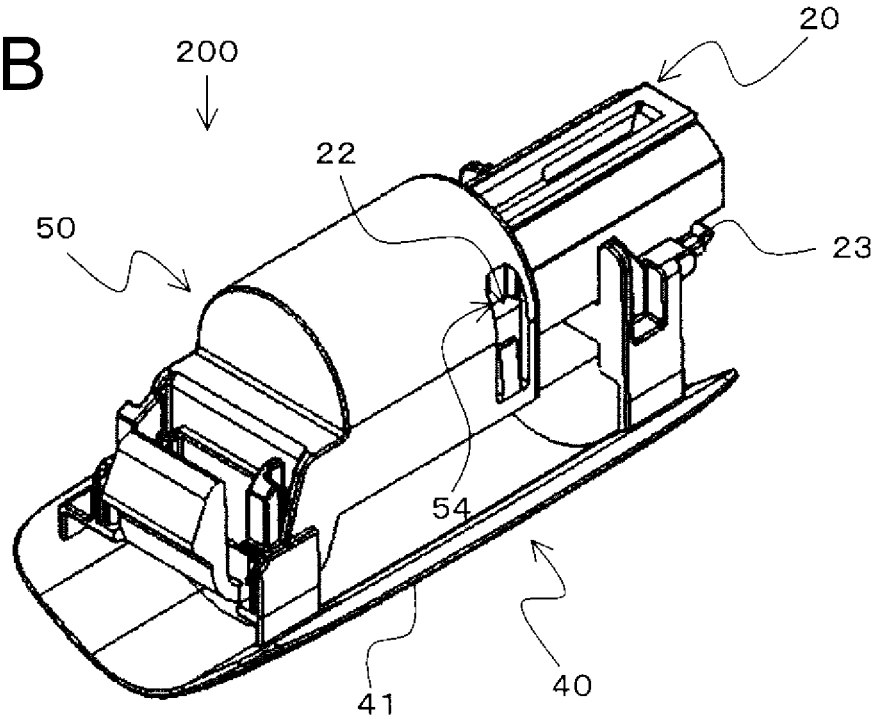
FIG. 2B is a perspective view of the illumination device as viewed from the side of a light leakage prevention cover.
Figure 3:
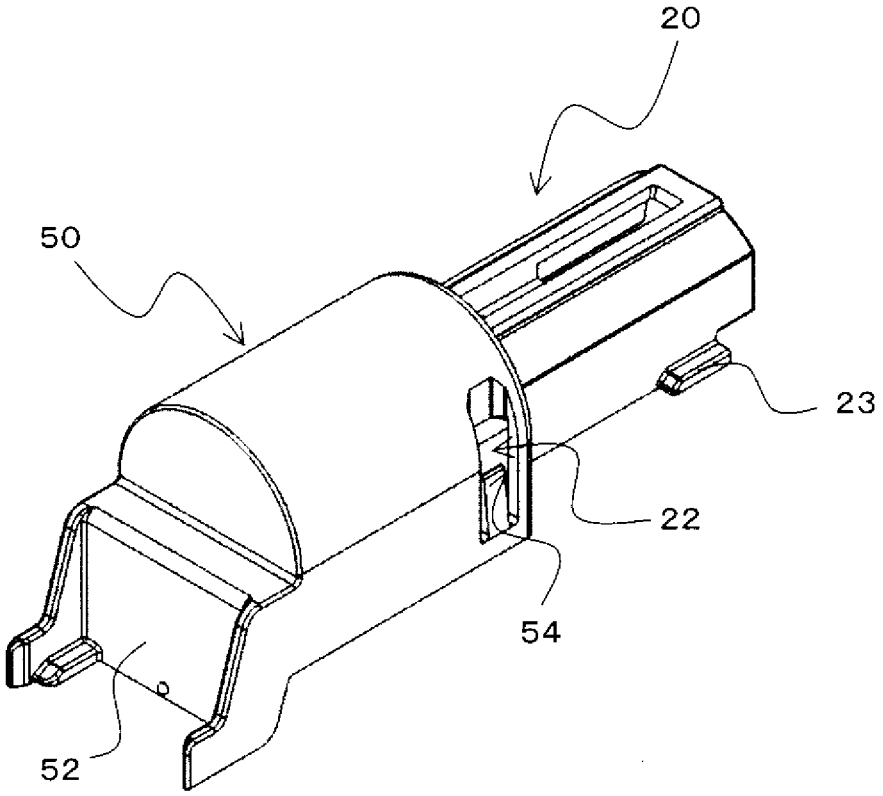
FIG. 3 is a perspective view, as viewed from the side of the light leakage prevention cover, of the illumination device to which the translucent lens has not been attached yet.
Figure 4:
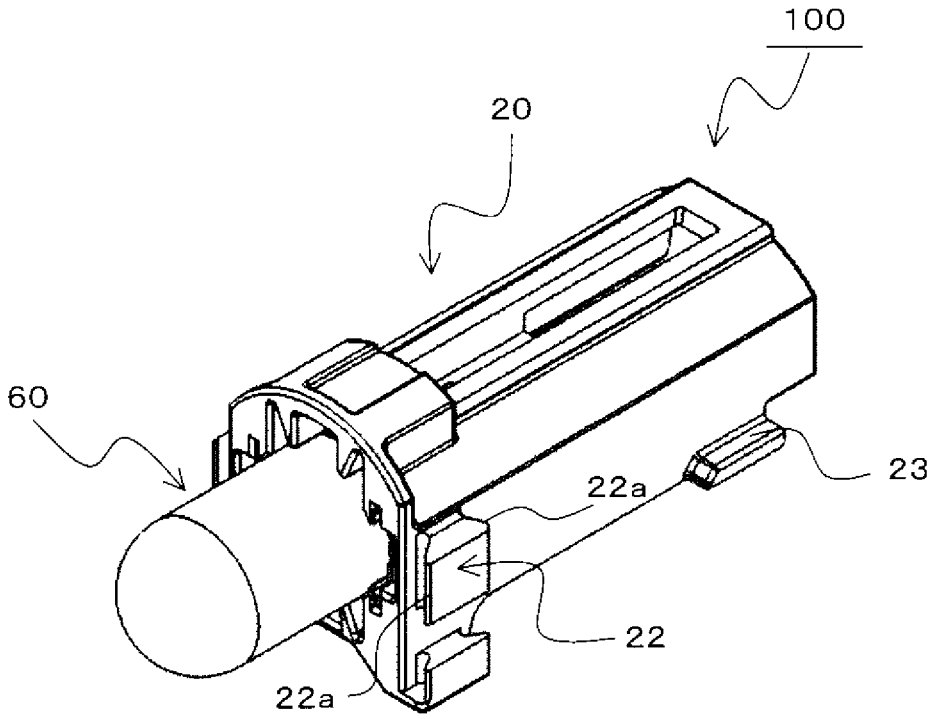
FIG. 4 is a perspective view of the bulb socket to which a bulb is attached.
Figure 5:
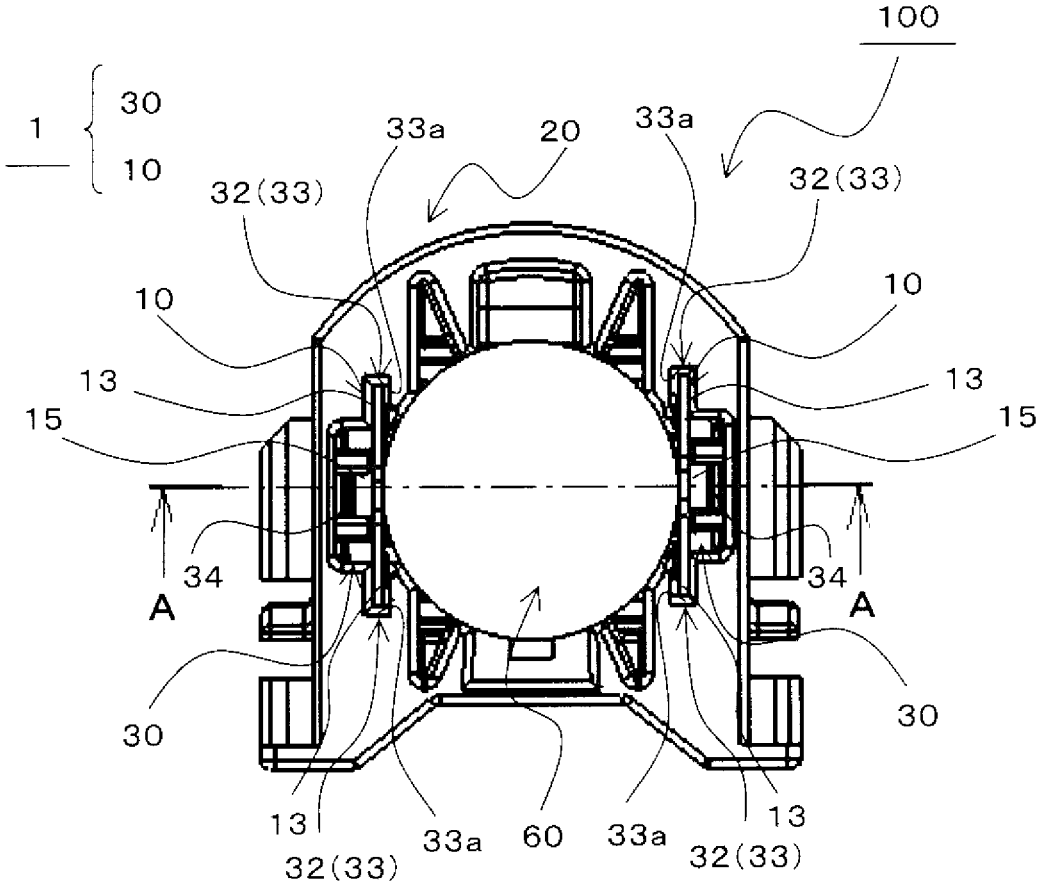
FIG. 5 is a front view, as viewed from the side of a bulb insertion opening, of the bulb socket to which the bulb is attached.
Figure 6A:
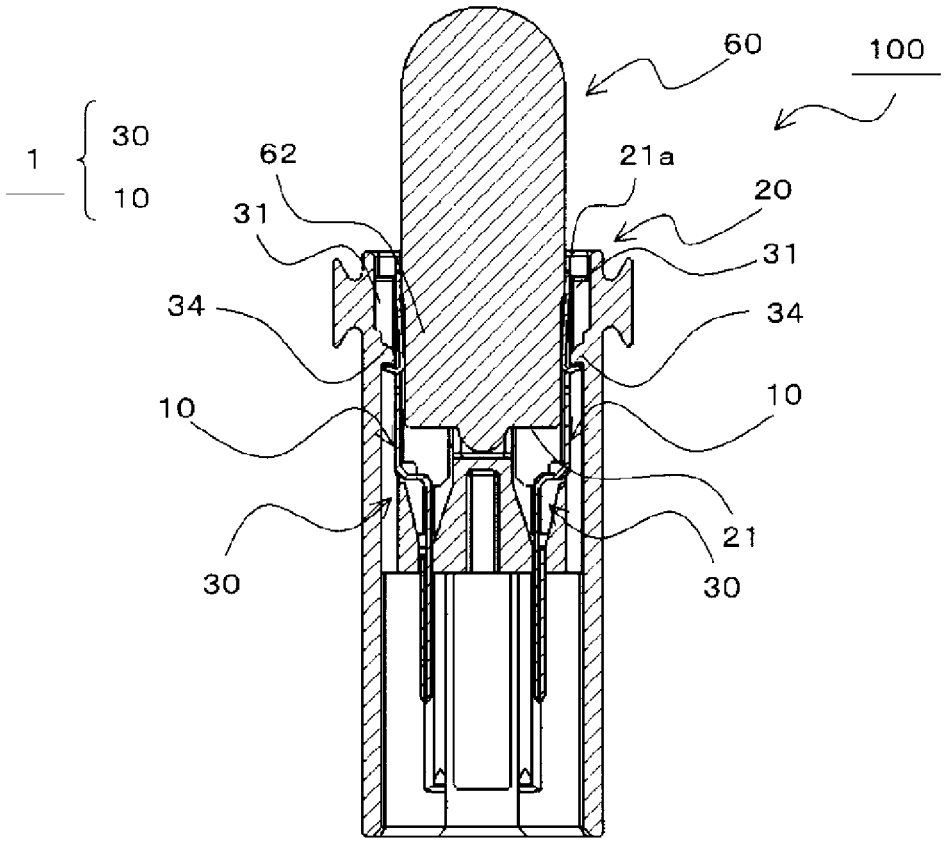
FIG. 6A is a sectional view of the illumination device taken along line A-A in FIG. 5.
Figure 6B:
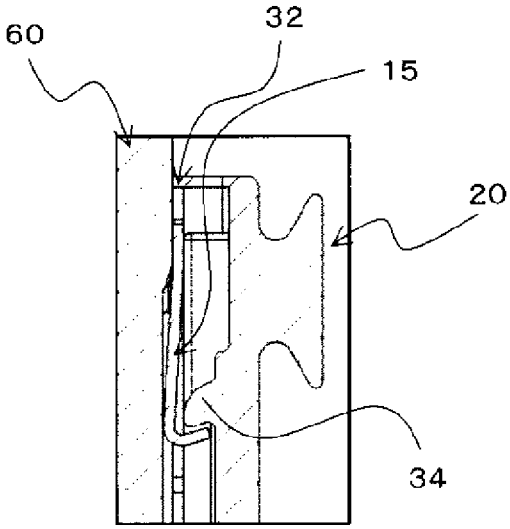
FIG. 6B is an enlarged view of part of FIG. 6A, that is, a holding-side lock projection and its neighborhood.
Figure 7:
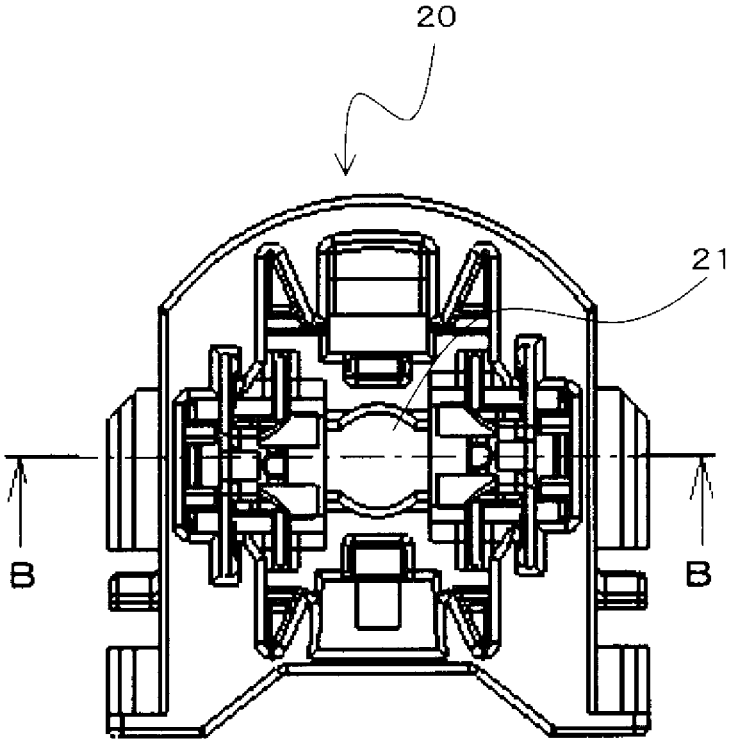
FIG. 7 is a front view of a socket main body as viewed from the side of the bulb insertion opening.
Figure 8A:
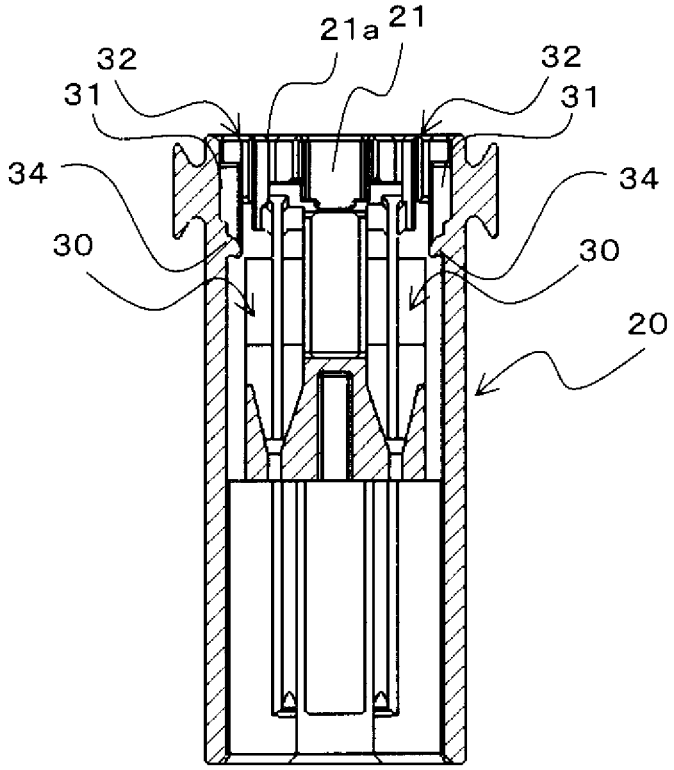
FIG. 8A is a sectional view of the socket main body taken along line B-B in FIG. 7.
Figure 8B:
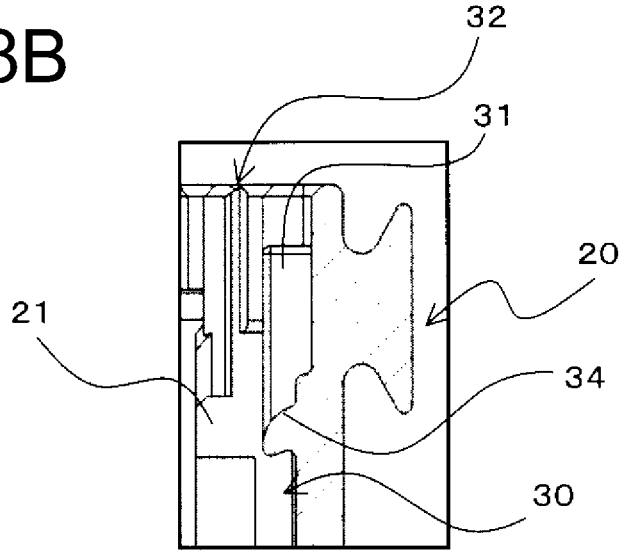
FIG. 8B is an enlarged view of part of FIG. 8A, that is, one holding-side lock portion and its neighborhood.
Figure 9A:
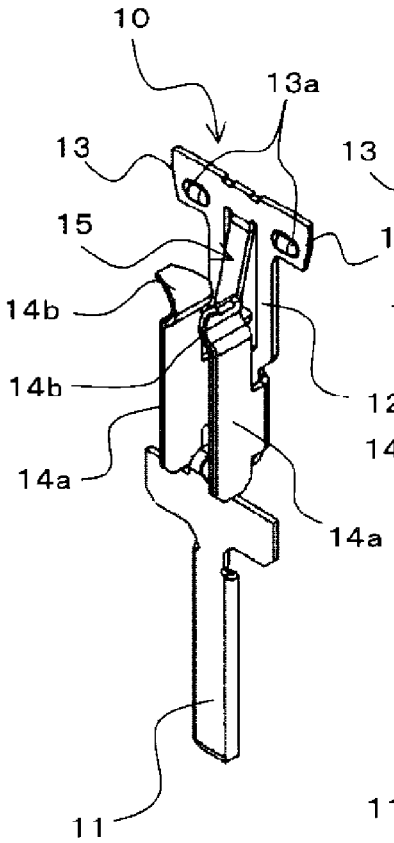
FIGS. 9A to 9C are a perspective view, a front view, and a side view of one terminal fitting, respectively.
Figure 9B:
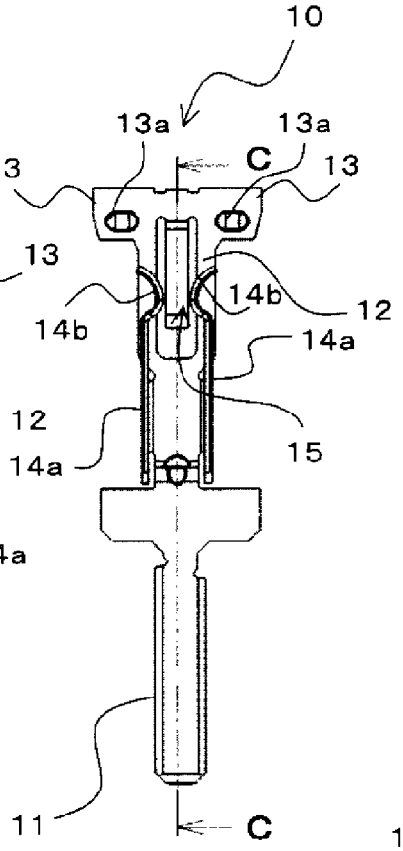
Figure 9C:
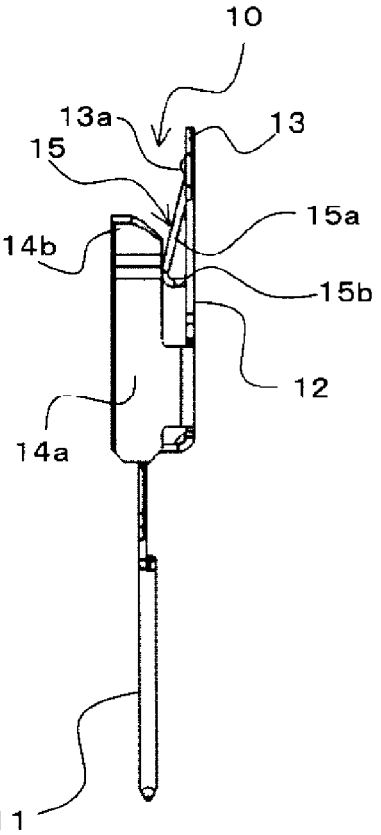
Figure 10A:
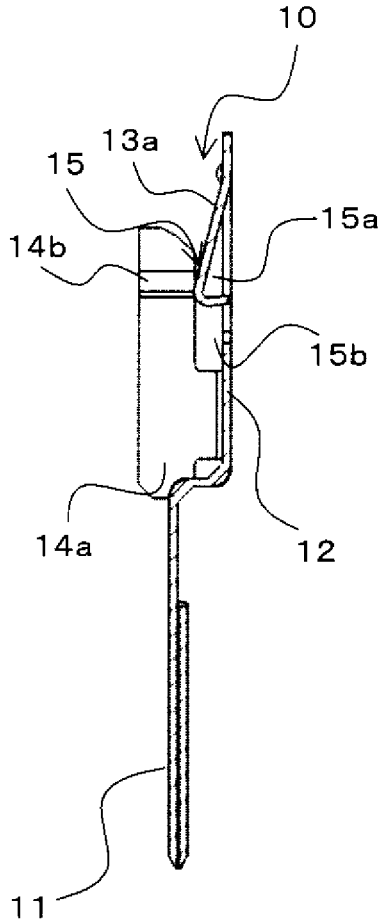
FIG. 10A is a sectional view of the terminal fitting taken along line C-C in FIG. 9B.
Figure 10B:
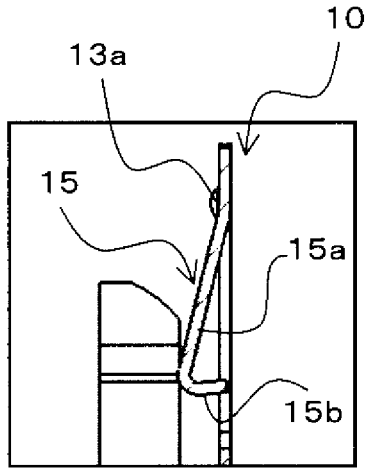
FIG. 10B is an enlarged view of part of FIG. 10A, that is, one terminal-side lock projection and its neighborhood.
Figure 11:
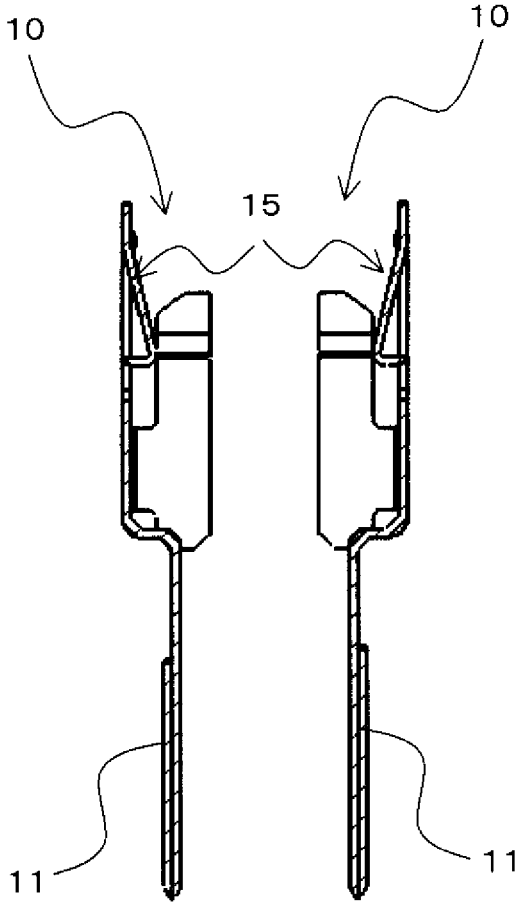
FIG. 11 is a sectional of a pair of terminal fittings which are arranged with orientations for insertion into the socket main body.
Figure 12:
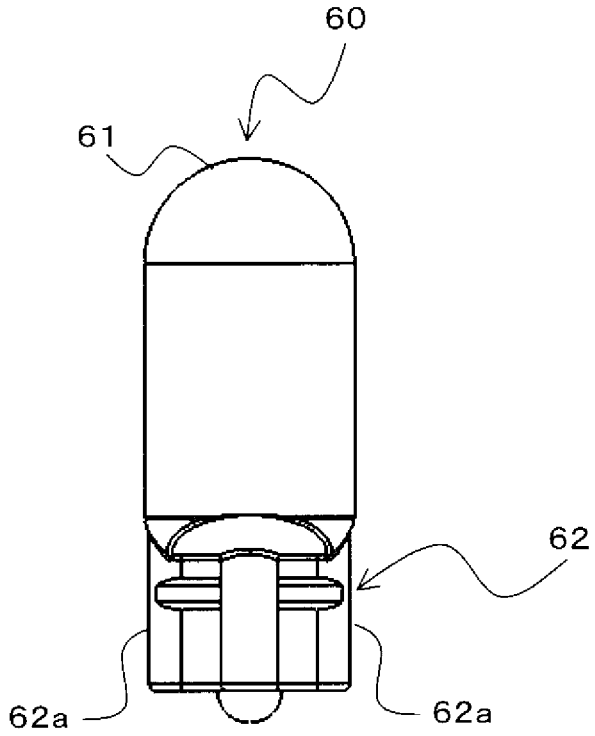
FIG. 12 is a front view of the bulb.

FIG. 1 is an exploded perspective view of an illumination device 200 which incorporates a bulb socket 100 which includes a locking structure 1 of terminal fittings according to a first embodiment of the present disclosure. FIG. 2A is a perspective view of the illumination device 200 as viewed from the side of a translucent lens 40, and FIG. 2B is a perspective view of the illumination device 200 as viewed from the side of a light leakage prevention cover 50. FIG. 3 is a perspective view, as viewed from the side of the light leakage prevention cover 50, of the illumination device 200 to which the translucent lens 40 has not been attached yet. FIG. 4 is a perspective view of the bulb socket 100 to which a bulb 60 is attached. FIG. 5 is a front view, as viewed from the side of a bulb 60 insertion opening 21*a*, of the bulb socket 100 to which the bulb 60 is attached. FIG. 6A is a sectional view of the illumination device 200 taken along line A-A in FIG. 5, and FIG. 6B is an enlarged view of part of FIG. 6A, that is, a holding-side lock projection 34 and its neighborhood. FIG. 7 is a front view of a socket main body 20 as viewed from the side of the bulb 60 insertion opening 21*a*. FIG. 8A is a sectional view of the socket main body 20 taken along line B-B in FIG. 7, and FIG. 8B is an enlarged view of part of FIG. 8A, that is, one holding-side lock portion 34 and its neighborhood. FIGS. 9A-9C are a perspective view, a front view, and a side view of one terminal fitting 10, respectively. FIG. 10A is a sectional view of the terminal fitting 10 taken along line C-C in FIG. 9B, and FIG. 10B is an enlarged view of part of FIG. 10A, that is, one terminal-side lock projection 15 (first lock projection) and its neighborhood. FIG. 11 is a sectional of a pair of terminal fittings 10 which are arranged with orientations for insertion into the socket main body 20. FIG. 12 is a front view of the bulb 60.

The locking structure 1 of terminal fittings and the bulb socket 100 according to the first embodiment of the present disclosure are incorporated in the illumination device 200 to be installed in an automobile or the like. The illumination device 200 is equipped with the bulb 60 which is a light source, the bulb socket 100, the translucent lens 40 for transmitting, to outside the device, light emitted from the bulb 60, and the light leakage prevention cover 50 for preventing leakage of light through portions other than the translucent lens 40.

First, the bulb 60 will be described. As shown in FIG. 1, the bulb 60, which is what is called a wedge base bulb, is equipped with a light emitting unit 61 in which a filament (not shown) is disposed inside a cylindrical glass member and an electrode unit 62 which is provided with a pair of terminals (not shown), that is, an anode terminal and a cathode terminal.

Next, the bulb socket 100 will be described. The bulb socket 100, which incorporates the locking structure 1 of terminal fittings, serves to supply power to the bulb 60.

The locking structure 1 of terminal fittings is equipped with the metal fittings 10 and terminal containing portions 30 which hold and house the respective terminal fittings 10 so that they are electrically connected to the bulb 60 (connection counterpart) when at least part of the bulb 60, that is, the electrode unit 62, is inserted in them. In the locking structure 1 of terminal fittings, terminal-side lock projections 15 which are provided in the terminal fittings 10 so as to be capable of elastic deformation are locked on the holding-side lock projections 34 (second lock projection) provided in the terminal containing portions 30, respectively.

The bulb socket 100 according to the first embodiment has the pair of terminal fittings 10 and the two terminal containing portions 30. The two terminal containing portions 30 are provided in the socket main body 20 which is the main body of the bulb socket 100.

The pair of metal fittings 10, which are what is called bus bars, are formed by punching a conductive metal plate and bending punched-out members. As shown in FIG. 11, the pair of metal fittings 10 are attached to the respective terminal containing portions 30 so as to be opposed to each other in a left-right symmetrical manner.

Each terminal fitting 10 has a fixing portion 11 which is fixed to the socket main body 20 and is to be connected to a cable (not shown), an extension portion 12 which extends from the fixing portion 11, press-fit portions 13 which project from the respective sides of a tip portion of the extension portion 12 so as to increase the width, a pair of terminal portions 14 which are bent from respective portions of the side edges of the extension portion 12 and are parallel with each other, and a terminal-side lock projection 15 which is a generally rectangular piece formed by cutting and erecting a portion of the extension portion 12.

The fixing portion 11 assumes a plate-like shape and extends in the top-bottom direction in FIGS. 9A-9C (longitudinal direction). The fixing portion 11 is disposed at a deep position inside the terminal containing portion 30.

The extension portion 12 is bent from the fixing portion 11 and then bent again so as to extend parallel with the fixing portion 11 toward the insertion opening 21*a* of an insertion space 21 (a crank shape is formed).

The press-fit portions 13, which are held by the respective terminal containing portions 30, project perpendicularly from the two respective sides of the tip portion of the extension portion 12. The press-fit portions 13 and the extension portion 12 assume a T shape together. Therefore, the press-fit portions 13 and the terminal-side lock projection 15 are not aligned in the direction in which the terminal fitting 10 is inserted in the terminal containing portion 30.

Each press-fit portion 13 has a positioning projection 13*a* which projects from its one surface. The press-fit portions 13 are press-fitted into respective terminal press-fit holding portions 32 (described later) so that the terminal fitting 10 is positioned at the lock position and held there.

Each of the pair of terminal portions 14 has a spring portion 14*a* which is bent from a side portion of the extension portion 12 (i.e., supported on one side) and extends toward the insertion opening 21*a* of the insertion space 21 and a contact portion 14*b* which is formed by bending a tip portion of the spring portion 14*a* so as to have a certain curved surface.

Having the above structure, the pair of terminal portions 14 nip the electrode unit 82 of the bulb 80 which is inserted in the insertion hole 21 and are thereby electrically connected to the electrode (not shown) provided in the electrode unit 82.

Before insertion of the bulb 60 (connection counterpart) to into the insertion space 21, each terminal-side lock projection 15 is in an elastically neutral state and projects to the insertion space 21 into which the electrode unit 62 (insertion portion) is to be inserted. When the bulb 60 is inserted in the insertion space 21, the electrode unit 62 pushes the terminal-side lock projection 15 so that it projects to the holding-side lock projection 34, whereupon the terminal-side lock projection 15 is locked on the holding-side lock projection 34.

More specifically, the terminal-side lock projection 15 has a cantilever spring portion 15*a* and a lock claw portion 15*b*. The cantilever spring portion 15*a* is formed by cutting and erecting a portion, opposed to the gap between the two respective contact portions 14*b* of the pair of terminal portions 14, of the extension portion 12 so as to be supported on one side and inclined gently so as to come closer to the insertion space 21 as the position goes toward the source side in the insertion direction. The lock claw portion 15*b* is formed by bending a tip portion of the spring portion 15*a* to the holding-side lock projection 34.

The lock claw portion 15*b* is formed so as not to project relative to the surface, located on the side of the holding-side lock projection 34, of the extension portion 12 in a state that the cantilever spring portion 15*a* is in an elastically neutral state. Therefore, in an elastically neutral state, the cantilever spring portion 15*a* is not in contact with the holding-side lock projection 34.

Next, the socket main body 20 will be described. The socket main body 20 is the main body of the bulb socket 100. The socket main body 20 is made of an insulating material such as a synthetic resin and generally assumes a cylindrical shape. Cables (not shown) are wired inside the socket main body 20 through the light leakage prevention cover 50 and connected to the respective terminal fittings 10, whereby power is supplied to the bulb 60.

The socket main body 20 has the insertion space 21 which receives the electrode unit 62 of the bulb 60, the pair of terminal containing portions 30 which form spaces each of which includes at least part of the insertion space 21 and is continuous with the insertion space 21 and thereby holds and houses the corresponding terminal fitting 10, cover lock portions 22 which are locked on the light leakage prevention cover 50, and lens engagement portions 23 which are engaged with the translucent lens 40.

Each terminal containing portion 30 has a guide space 31 through which to guide the terminal fitting 10 to the lock position of the holding-side lock projection 34, terminal press-fit holding portions 32 which hold the terminal fitting 10 at the lock position, and the holding-side lock portion 34 on which the terminal-side lock projection 15 is locked.

The guide space 31 is a space that is continuous with the insertion space 21 and serves to guide the terminal fitting 10 to the lock position.

The terminal press-fit holding portions 32 are provided in each terminal containing portion 30 so as to be press-fitted with and thereby hold the respective press-fit portions 13 of the terminal fitting 10. The terminal press-fit holding portions 33 have, at top and bottom positions adjacent to the insertion space 21, a pair of press-fit groove portions 33 which are press-fitted with the two respective press-fit portions 13 of the terminal fitting 10. Each press-fit groove portion 32 is formed with a press-fit groove 33 which extends inward from an end portion, adjacent to the insertion opening 21*a* of the insertion space 21, of the socket main body 20.

The groove depth of the top and bottom press-fit groove portions 34 adjacent to the insertion space 21 is set so as not to interfere with the holding-side lock projection 34. More specifically, the groove depth is set approximately equal to the width of the press-fit portions 13.

The holding-side lock projection 34 is formed so as to project from the inner wall surface of the corresponding terminal containing portion 30 into the electrode unit 62 insertion space 21.

Each cover lock portion 23 has a pair of projected guide flanges 22*a* which extend straightly in the direction in which the light leakage prevention cover 50 is slid when it is attached to the socket main body 20. The pair of projected guide flanges 22*a* are locked on a corresponding lock counterpart portion 74 (described later) of the light leakage prevention cover 70 when the pair of projected guide flanges 23*a* are slid relative to and fitted into respective guide grooves 54*a* of the lock counterpart portion 54.

The translucent lens 40 is made of a light transparent resin material, and is composed of a lens main body 41 which is shaped like a curved plate and a first attachment portion 42 and a second attachment portion 43 which project from the inner surface of the lens main body 41.

The first attachment portion 62 has a lock piece 42*a* which projects outward parallel with an end portion, opposite to the insertion opening 21*a* of the insertion space 21, of the socket main body 20 and a pair of first engagement portions 42*b* which can be engaged with respective lens engagement portions 23 of the socket main body 20. The second attachment portion 43 has a lock portion 43*a* which can be engaged with an interior member (not shown) of a vehicle and a pair of second engagement portions 43*b* which can be engaged with respective lens engagement portions 53*a* of the light leakage prevention cover 50.

The light leakage prevention cover 50 is made of an insulating material such as a synthetic resin, and is composed of a cover main body 51 which is generally shaped like a semicylinder, an end wall 52 which is continuous with one end portion of the cover main body 51 and covers the light emitting unit 61 of the bulb 60 that is attached to the socket main body 20, and a pair of flanges 53 which project from the sides of the end wall 52.

The inner surface of the cover main body 51 is formed with a reflection surface (not shown) for reflecting, toward the translucent lens 40, light emitted from the light emitting unit 61 so that light can be radiated outward efficiently from the translucent lens 40.

The cover main body 71 is also formed with the pair of lock counterpart portions 54 on which the respective cover lock portions 22 of the socket main body 20 are locked. Each lock counterpart portion 54 has the pair of guide grooves 54*a* which are fitted with the respective projected guide flanges 22*a* of the corresponding cover lock portion 22. The light leakage prevention cover 50 is pressed downward (as viewed in FIG. 1) against the socket main body 20, whereby the guide grooves 54*a* come to be fitted with the respective projected guide flanges 22*a*.

The flanges 53 have the respective lens engagement portions 53*a* which are engaged with the translucent lens 40. The lens engagement portions 53*a* are slid to be engaged with the respective second engagement portions 43*b* of the translucent lens 40.

Next, an assembling procedure of the illumination device 200 and how the individual portions work during that course will be described with reference to FIG. 13 to FIGS. 15A and 15B.

Figure 13:
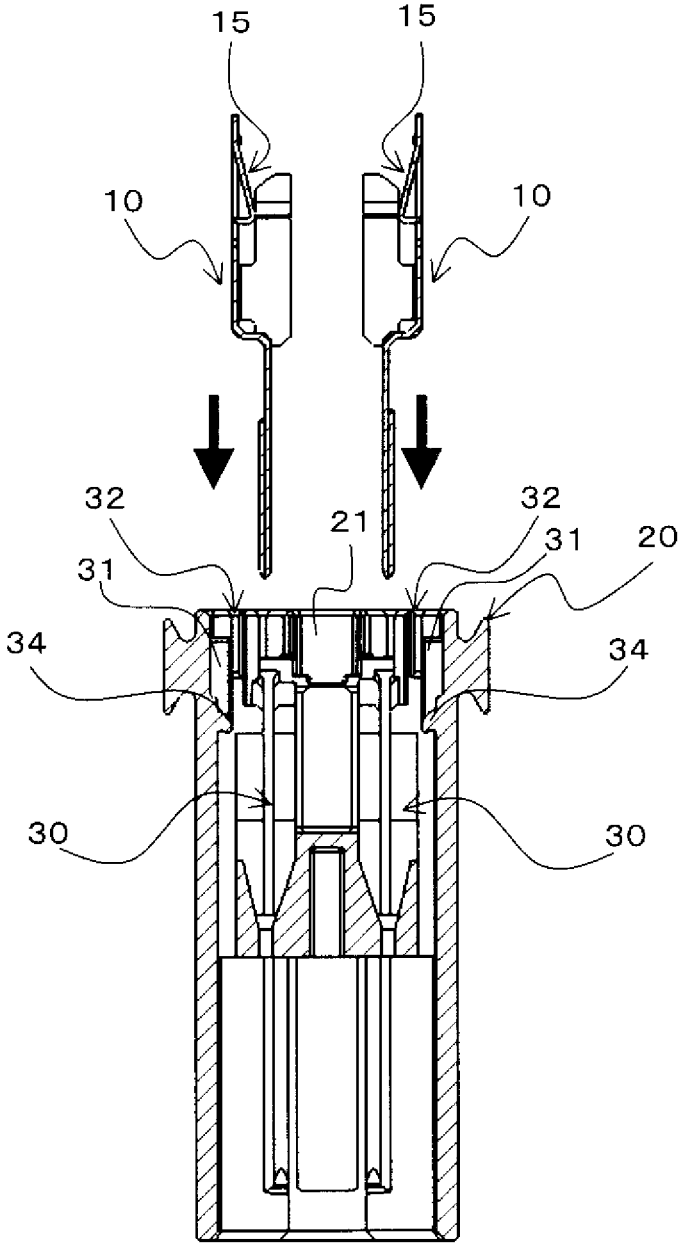
FIG. 13 shows a state before insertion of the pair of terminal fittings into respective terminal containing portions of the socket main body.
Figure 14A:
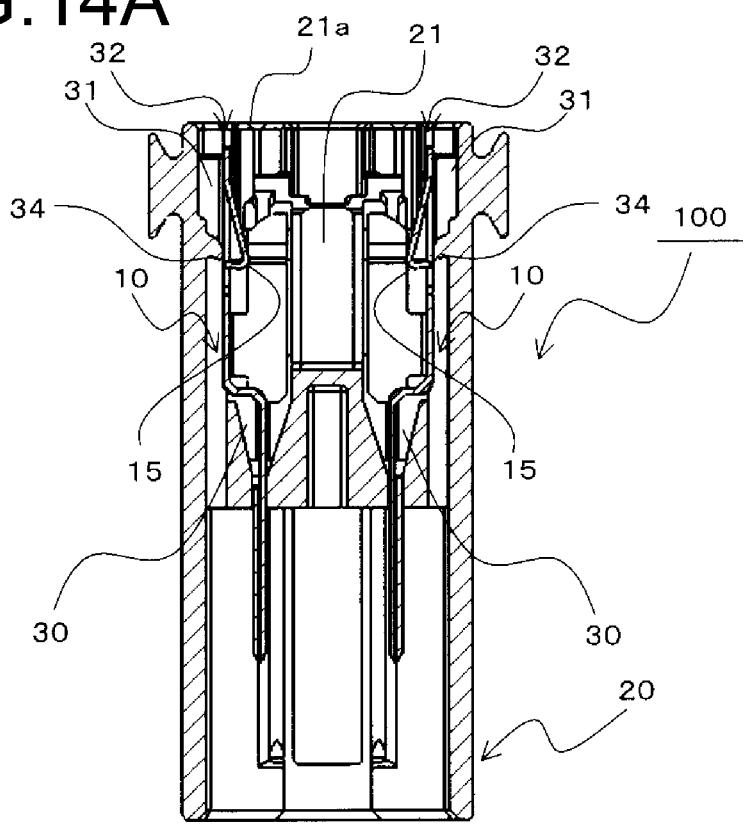
FIG. 14A shows a state that the pair of terminal fittings have reached the lock positions.
Figure 14B:
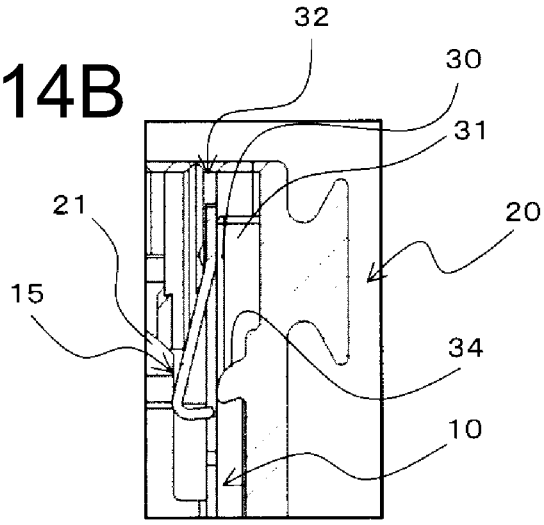
FIG. 14B is an enlarged view of part of FIG. 14A, that is, one holding-side lock portion and its neighborhood.
Figure 15A:
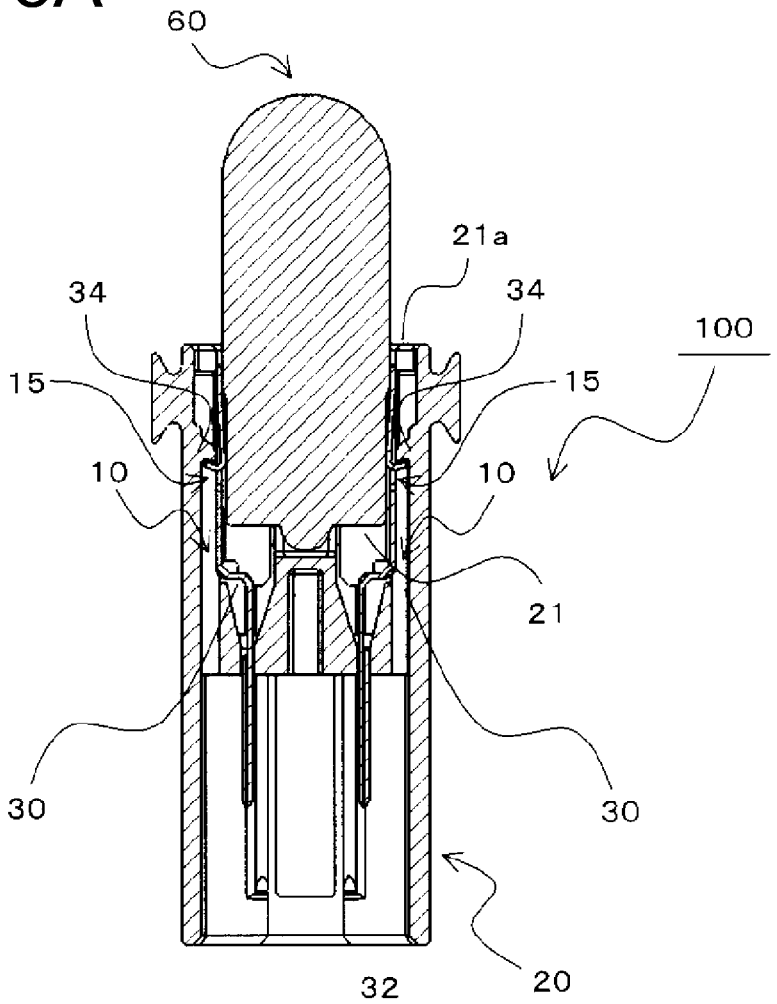
FIG. 15A shows a state that the bulb 60 is attached to the socket main body.
Figure 15B:
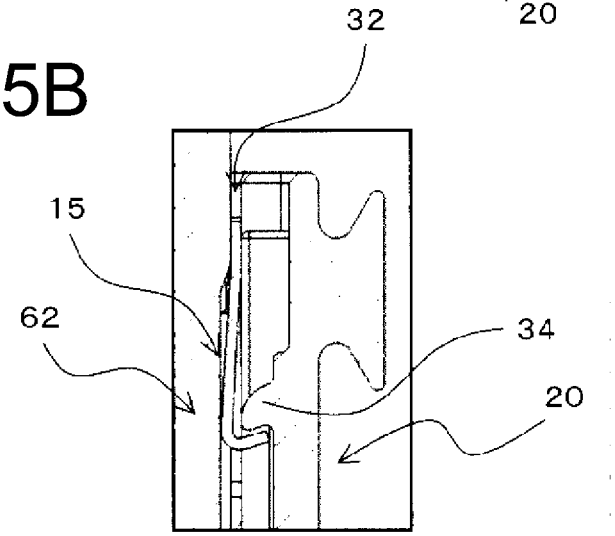
FIG. 15B is an enlarged view of part of FIG. 15A, that is, one holding-side lock portion and its neighborhood.

FIG. 13 shows a state before insertion of the pair of terminal fittings 10 into the respective terminal containing portions 30 of the socket main body 20. FIG. 14A shows a state that the pair of terminal fittings 10 have reached the lock positions, and FIG. 14B is an enlarged view of part of FIG. 14A, that is, one holding-side lock portion 34 and its neighborhood. FIG. 15A shows a state that the bulb 60 is attached to the socket main body 20, and FIG. 15B is an enlarged view of part of FIG. 15A, that is, one holding-side lock portion 34 and its neighborhood.

First, the worker inserts the pair of terminal fittings 10 into the respective terminal containing portions 30 of the socket main body 20 (see FIG. 13 and FIGS. 14A and 14B).

Each terminal-side lock projection 15 does not come into contact with the terminal containing portion 30 halfway before the terminal fitting 10 reaches the lock position because the terminal-side lock projection 15 projects to the insertion space 21 rather the holding-side lock projection 34. Therefore, the terminal-side lock projection 15 is not deformed elastically halfway before the terminal fitting 10 reaches the lock position.

When the terminal fitting 10 reaches the lock position, the press-fit portions 13 are fitted into the press-fit grooves 33*a* of the terminal press-fit holding portions 32, respectively, and held at the lock position in the terminal containing portion 30 by means of the positioning projections 13*a* of the terminal fitting 10.

In this state, although the terminal fitting 10 is held by the terminal press-fit holding portions 32 at the lock position, the terminal-side lock projection 15 has not been locked on the holding-side lock projection 34 yet.

Subsequently, as shown in FIGS. 15A and 15B, the worker attaches the bulb 60 to the socket main body 20. As a result, each side portion 62*a* of the electrode unit 62 that is inserted in the insertion space 21 pushes, to the holding-side lock projection 34, the terminal-side lock projection 15 that has so far projected to the insertion space 21, whereby the lock claw portions comes to project to the holding-side lock projection 34 and the terminal-side lock projection 15 is locked on the holding-side lock projection 34.

Each side portion 62*a* of the electrode unit 62 restricts elastic deformation of the terminal-side lock projection 15 in the direction in which it is unlocked from the holding-side lock projection 34.

Then the worker attaches the light leakage prevention cover 50 to the socket main body 20. This is done by locking the pair of cover lock portions 22 of the socket main body 20 on the respective lock counterpart portions 54 of the light leakage prevention cover 50. Finally, the worker attaches the translucent lens 40 to the assembly of the bulb socket 100 and the light leakage prevention cover 50. More specifically, the worker slides the assembly of the bulb socket 100 and the light leakage prevention cover 50 with respect to the translucent lens 40, whereby the pair of lens engagement portions 53*a* of the light leakage prevention cover 50 are engaged with the respective second engagement portions 43*b* of the translucent lens 40 and the pair of first lens engagement portions 34 of the socket main body 20 are engaged with the respective first engagement portions 42*b* of the translucent lens 40.

In the locking structure 1 of terminal fittings according to the first embodiment of the present disclosure, the electrode unit 62 (connection counterpart) of the bulb 60 restricts elastic deformation of each terminal-side lock projection 15 (which is provided in the terminal fitting 10 so as to be capable of elastic deformation) in the direction in which it is unlocked from the holding-side lock projection 34. As a result, lowering of the forces for locking of the terminal fittings 10 can be prevented.

In the locking structure 1 of terminal fittings according to the first embodiment of the present disclosure, each terminal-side lock projection 15 being in an elastically neutral state projects to the electrode unit 62 insertion space 21. When the bulb 60 is inserted in the insertion space 21, the electrode unit 62 causes the terminal-side lock projection 15 of the terminal fitting 10 located at the lock position to project to the holding-side lock projection 34. Therefore, the terminal-side lock projection 15 is not deformed elastically by coming into contact with the holding-side lock projection 34 before the terminal fitting 10 reaches the lock position. As a result, reduction of the resilience of the terminal-side lock projection 15 can be prevented and hence the locking force can be increased.

Furthermore, according to the locking structure 1 of terminal fittings according to the first embodiment of the present disclosure, the terminal fittings 10 can be held at the lock positions even before the bulb 60 is inserted in the insertion space 21.

The bulb socket 100 according to the first embodiment of the present disclosure incorporates the locking structure 1 of terminal fittings. Therefore, the electrode unit 62 of the bulb 60 restricts elastic deformation of each terminal-side lock projection 15 (which is provided in the terminal fitting 10 so as to be capable of elastic deformation) in the direction in which it is unlocked from the holding-side lock projection 34. As a result, lowering of the forces for locking of the terminal fittings 10 can be prevented.

[Embodiment 2]

The configurations of a locking structure 2 of terminal fittings and a bulb socket 300 according to a second embodiment of the present disclosure will be described below with reference to FIG. 16 to FIGS. 23A and 23B.

Figure 16:
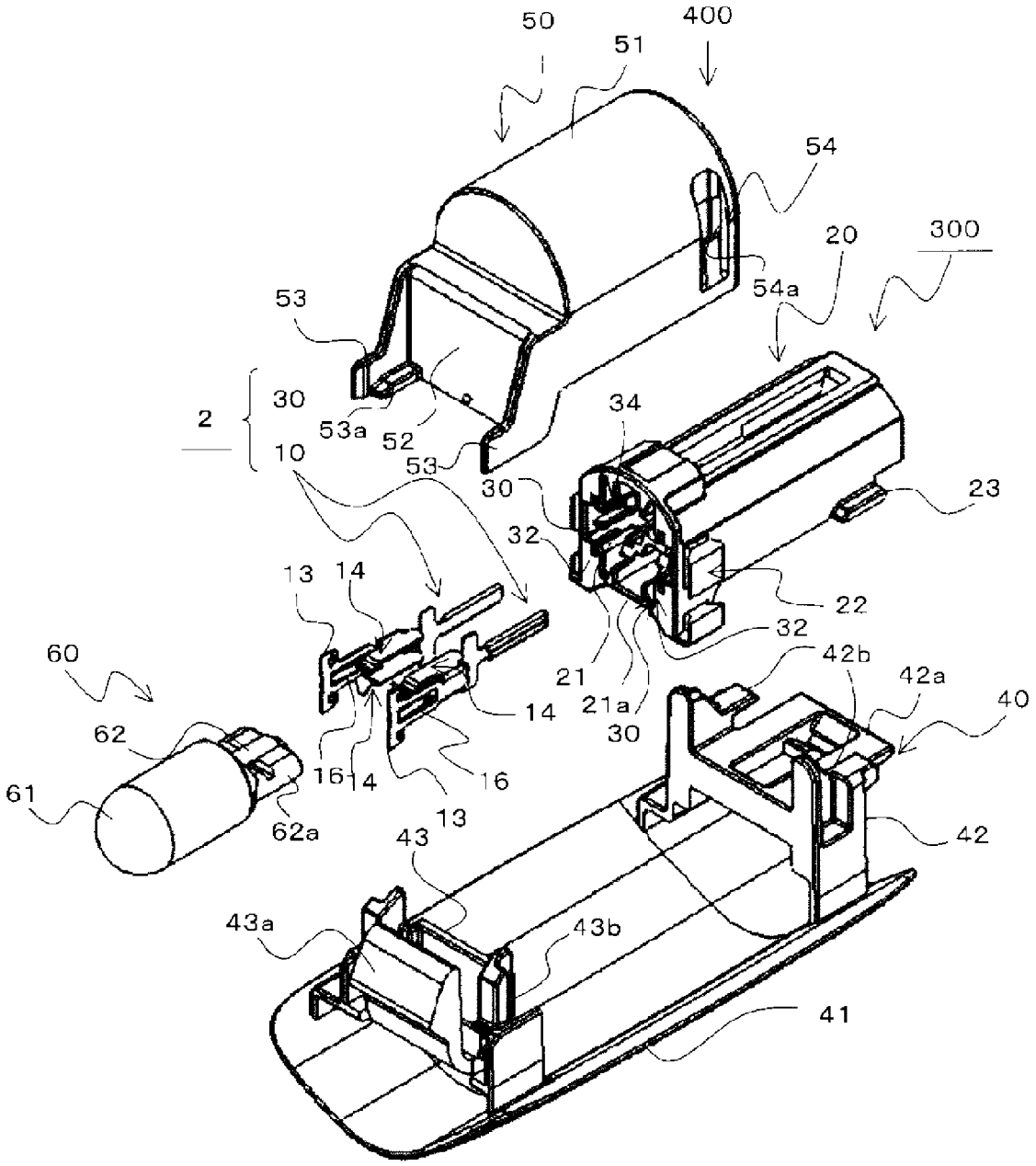
FIG. 16 is an exploded perspective view of an illumination device according to a second embodiment of the present disclosure.
Figure 17:
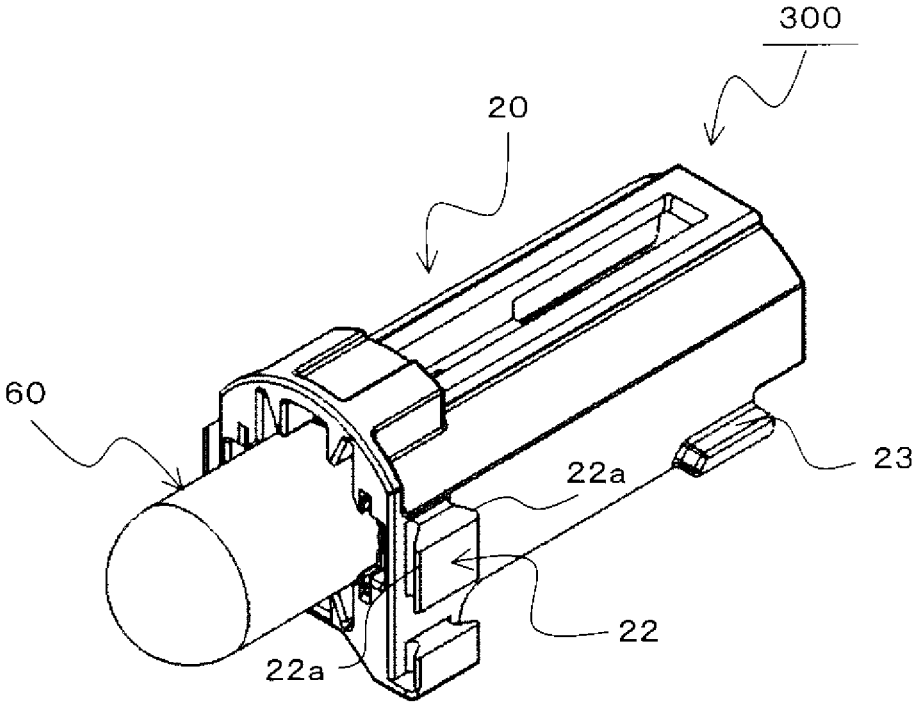
FIG. 17 is a perspective view of bulb socket to which a bulb is attached.
Figure 18:
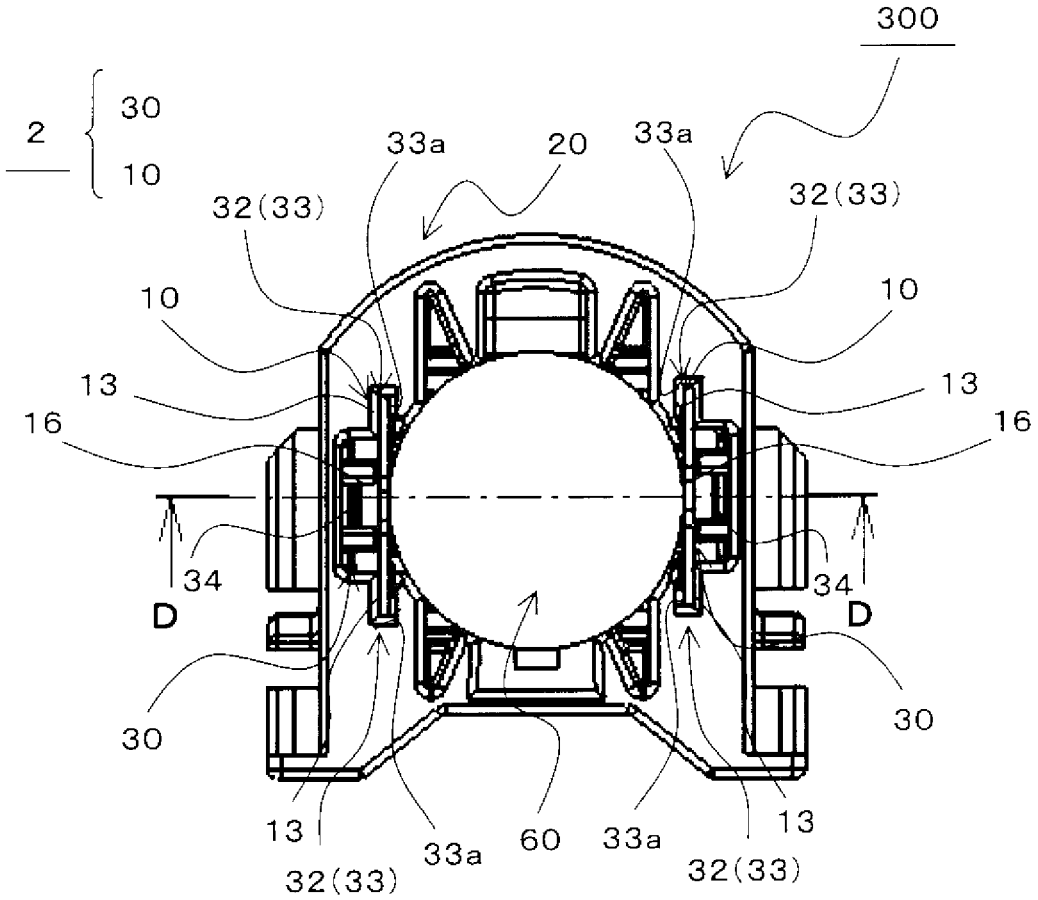
FIG. 18 is a front view, as viewed from the side of a bulb insertion opening, of the bulb socket to which the bulb is attached.
Figure 19A:
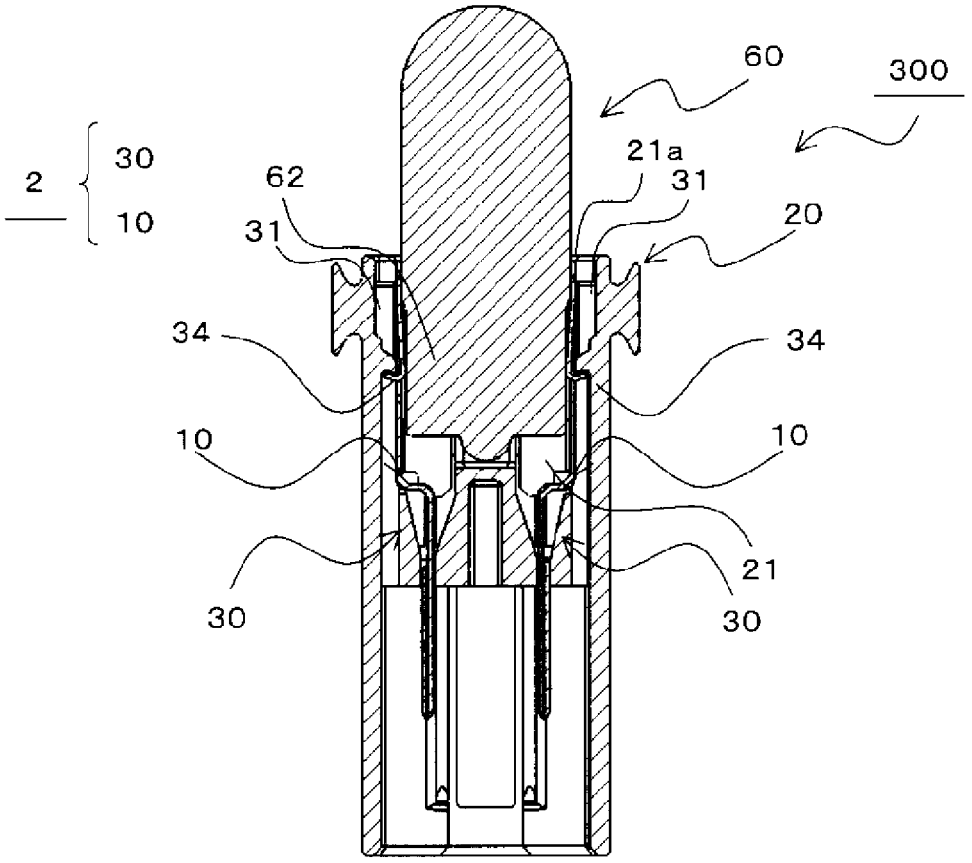
FIG. 19A is a sectional view of the illumination device taken along line D-D in FIG. 18.
Figure 19B:
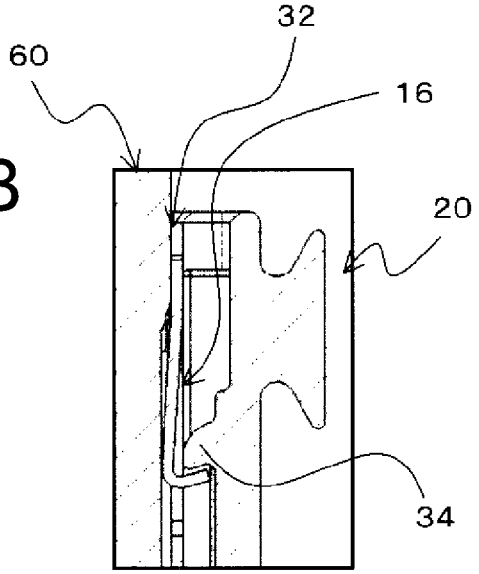
FIG. 19B is an enlarged view of part of FIG. 19A, that is, one holding-side lock portion and its neighborhood.
Figure 20:
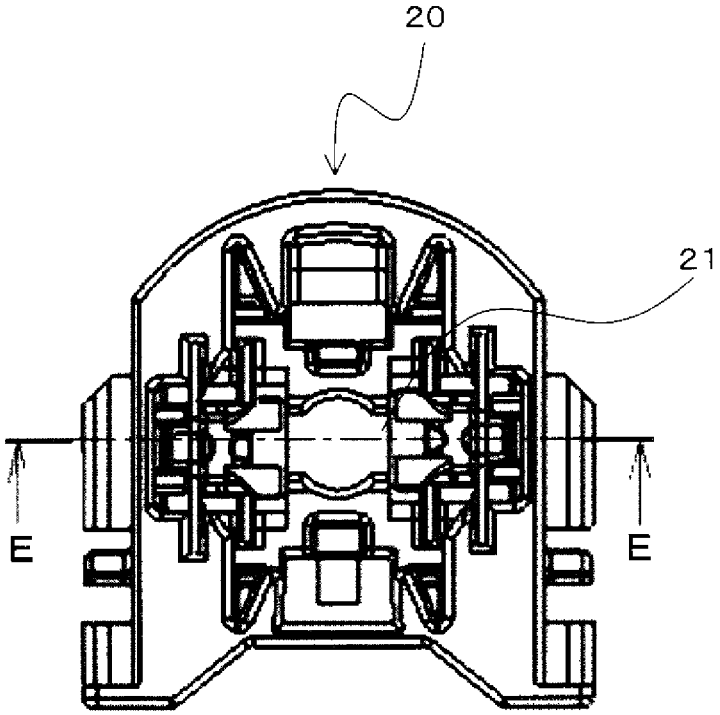
FIG. 20 is a front view of a socket main body as viewed from the side of the bulb insertion opening.
Figure 21A:
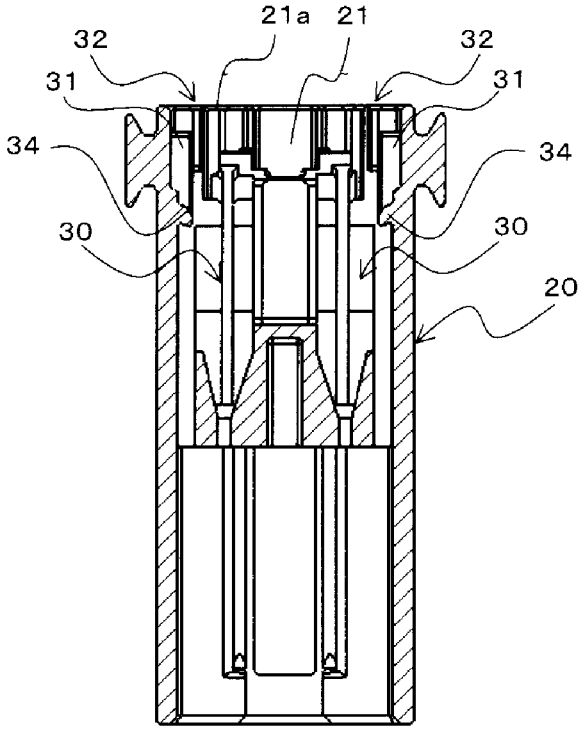
FIG. 21A is a sectional view of the socket main body taken along line E-E in FIG. 20.
Figure 21B:
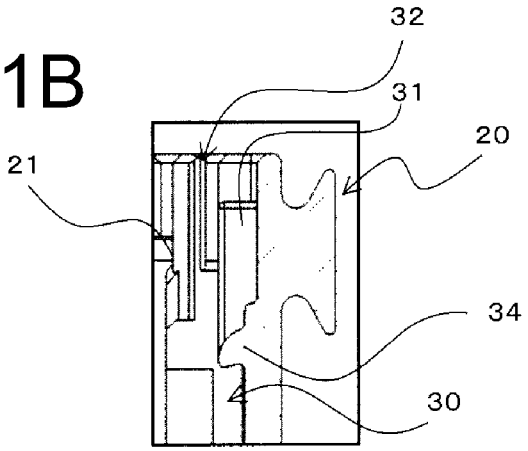
FIG. 21B is an enlarged view of part of FIG. 21A, that is, one holding-side lock projection and its neighborhood.
Figures 22A, 22B, 22C:
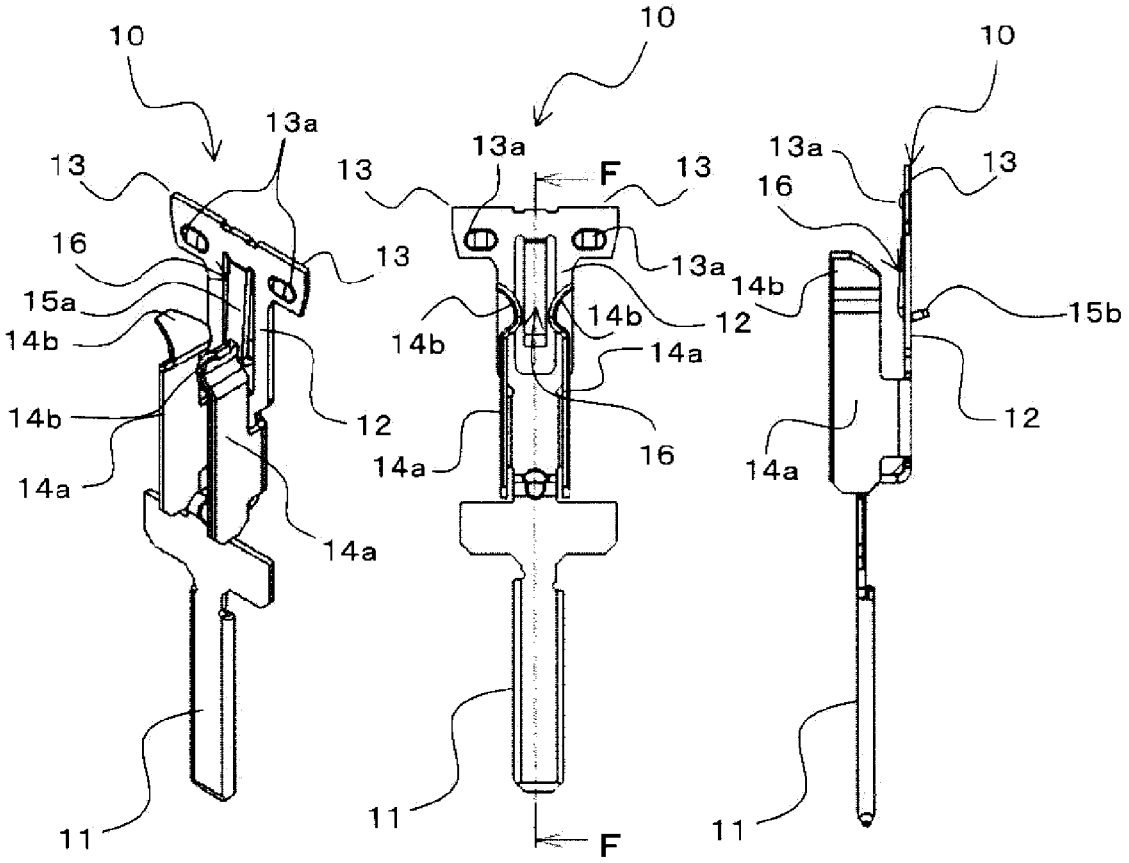
FIGS. 22A to 22C are a perspective view, a front view, and a side view of one terminal fitting, respectively.
Figure 23A:
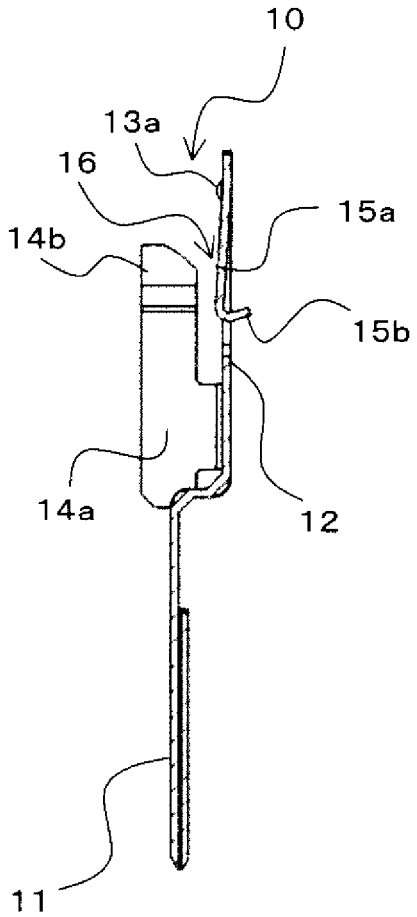
FIG. 23A is a sectional view of the terminal fitting 10 taken along line F-F in FIG. 22B.
Figure 23B:
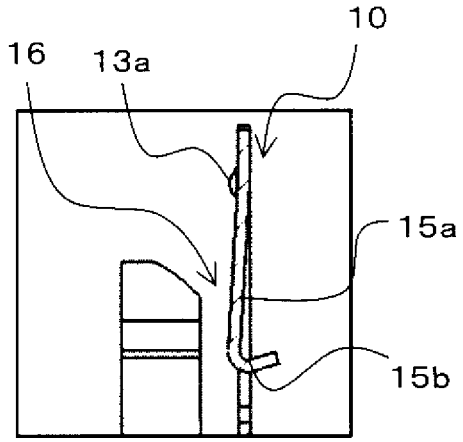
FIG. 23B is an enlarged view of part of FIG. 23A, that is, one terminal-side lock projection and its neighborhood.

FIG. 16 is an exploded perspective view of an illumination device 400 according to the second embodiment of the present disclosure. FIG. 17 is a perspective view of the bulb socket 100 to which a bulb 60 is attached. FIG. 18 is a front view, as viewed from the side of a bulb 60 insertion opening 21*a*, of the bulb socket 300 to which the bulb 60 is attached. FIG. 19A is a sectional view of the illumination device 400 taken along line D-D in FIG. 18, and FIG. 19B is an enlarged view of part of FIG. 19A, that is, one holding-side lock portion 34 and its neighborhood. FIG. 20 is a front view of a socket main body 20 as viewed from the side of the bulb 60 insertion opening 21*a*. FIG. 21A is a sectional view of the socket main body 20 taken along line E-E in FIG. 20, and FIG. 21B is an enlarged view of part of FIG. 21A, that is, one holding-side lock projection 34 and its neighborhood. FIGS. 22A-22C are a perspective view, a front view, and a side view of one terminal fitting 10, respectively. FIG. 23A is a sectional view of the terminal fitting 10 taken along line F-F in FIG. 22B, and FIG. 23B is an enlarged view of part of FIG. 23A, that is, one terminal-side lock projection 16 and its neighborhood.

The locking structure 2 of terminal fittings and the bulb socket 300 according to the second embodiment of the present disclosure are different from the locking structure 1 of terminal fittings and the bulb socket 100 according to the first embodiment in that the lock claw portion 15*b* of the terminal-side lock projection 16 being in an elastically neutral state projects relative to the holding-side-lock-projection-34-side surface of the extension portion 12. The other members etc. are the same as in the first embodiment, and constituent elements having the same ones in the first embodiment will be given the same reference symbols as the latter.

As in the first embodiment, the locking structure 2 of terminal fittings and the bulb socket 300 according to the second embodiment of the present disclosure are incorporated in the illumination device 400 to be installed in an automobile or the like. The illumination device 400 is equipped with the bulb 60 which is a light source, the bulb socket 300, a translucent lens 40 for transmitting, to outside the device, light emitted from the bulb 60, and a light leakage prevention cover 50 for preventing leakage of light through portions other than the translucent lens 40.

Each terminal-side lock projection 16 has a cantilever spring portion 15*a* formed by cutting and erecting a portion, opposed to the gap between the two respective contact portions 14*b*, of the extension portion 12 so as to be supported on one side and inclined gently so as to come closer to the side of the insertion space 21 as the position goes toward the source side in the insertion direction, and a lock claw portion 15*b* formed by bending a tip portion of the spring portion 15*a* to the side of the holding-side lock projection 34.

The lock claw portion 15*b* is formed so as to project relative to the surface, located on the side of the holding-side lock projection 34, of the extension portion 12 in a state that the cantilever spring portion 15*a* is in an elastically neutral state. That is, the lock claw portion 15*b* is formed by cutting and erecting a portion of the extension portion 12 to the side of the insertion space 21 with a small inclination angle so that the lock claw portion 15*b* projects relative to the holding-side-lock-projection-34-side surface of the extension portion 12.

With this structure, when each terminal-side lock projection 16 is locked on the holding-side lock projection 34, the cantilever spring portion 15*a* is bent toward the side of the insertion space 21 to allow the lock claw portion 15*b* to climb over the holding-side lock projection 34.

Next, an assembling procedure of the illumination device 400 and how the individual portions work during that course will be described with reference to FIGS. 19A and 19B and FIG. 24 to FIGS. 26A and 26B.

Figure 24:
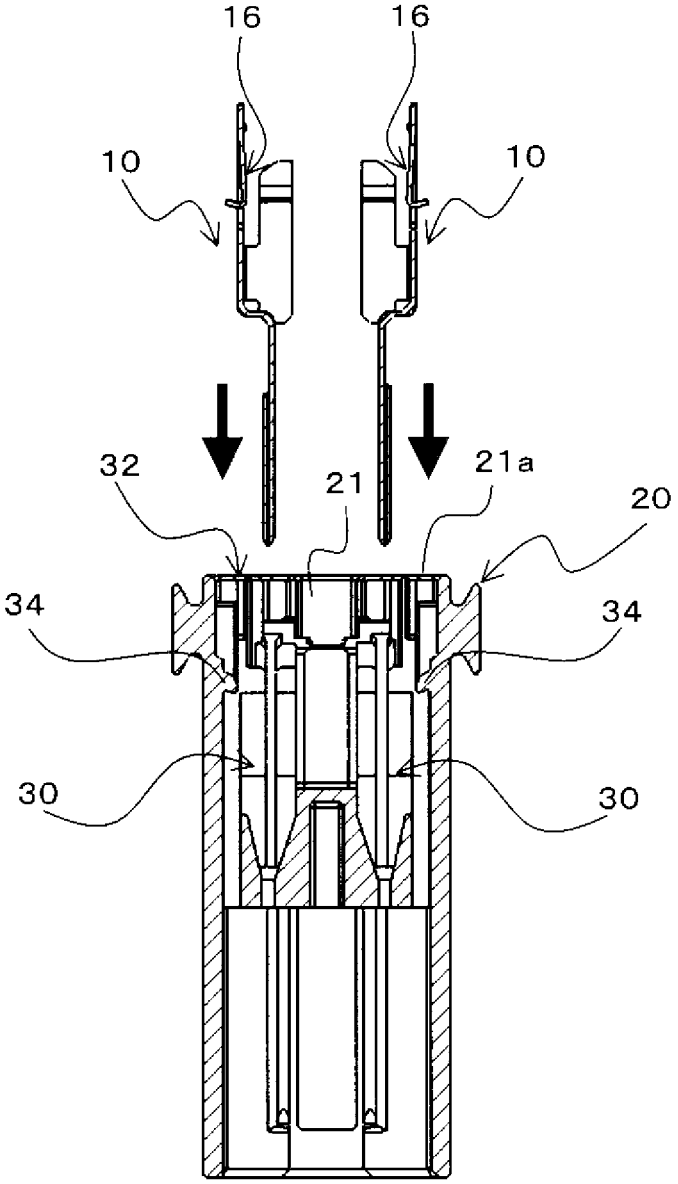
FIG. 24 shows a state before insertion of the pair of terminal fittings into the respective terminal containing portions of the socket main body.
Figure 25A:
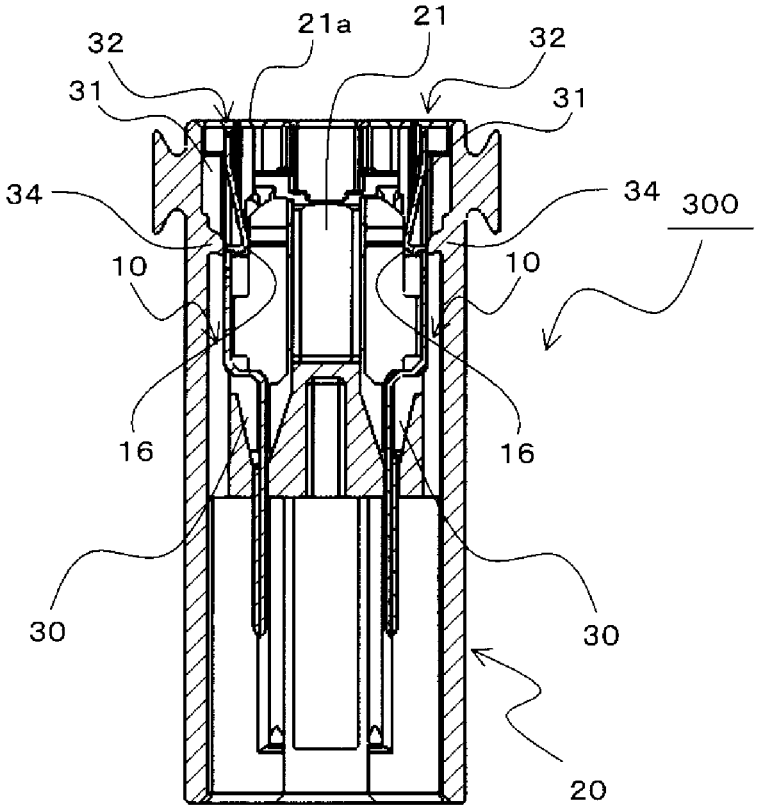
FIG. 25A shows a state immediately before the pair of terminal fittings reach the lock positions.
Figure 25B:
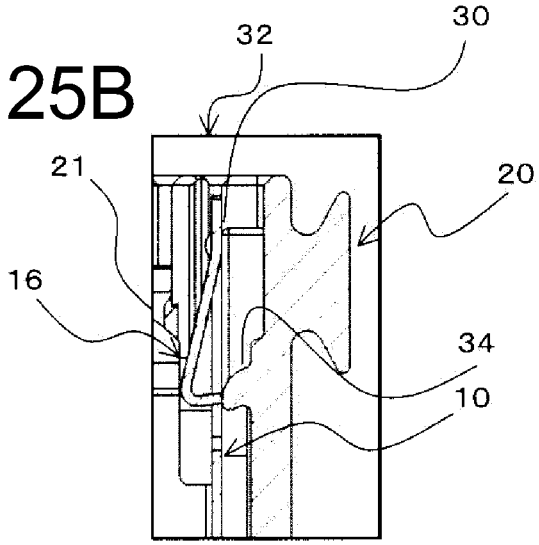
FIG. 25B is an enlarged view of part of FIG. 25A, that is, one holding-side lock portion and its neighborhood.
Figure 26A:
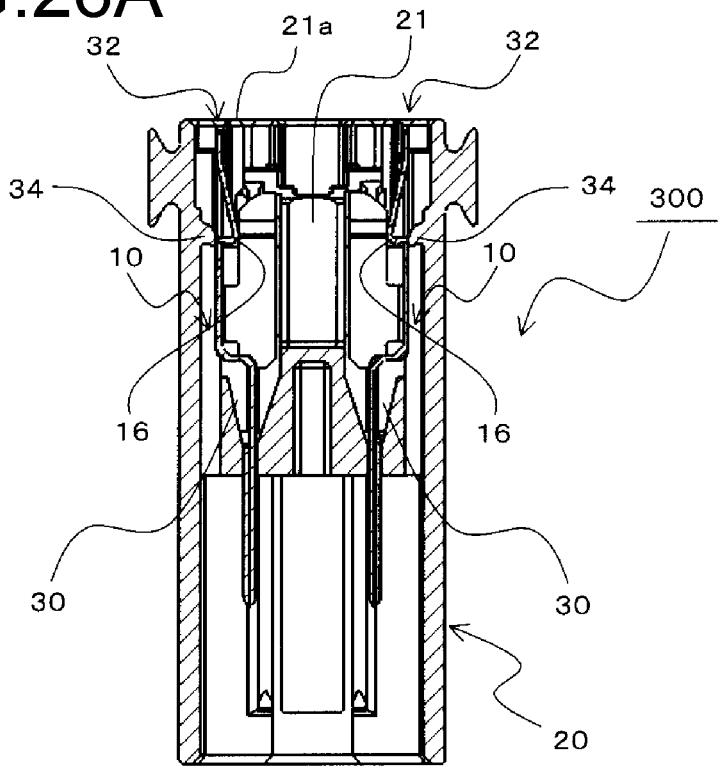
FIG. 26A shows a state that the pair of terminal fittings have reached the lock positions.
Figure 26B:
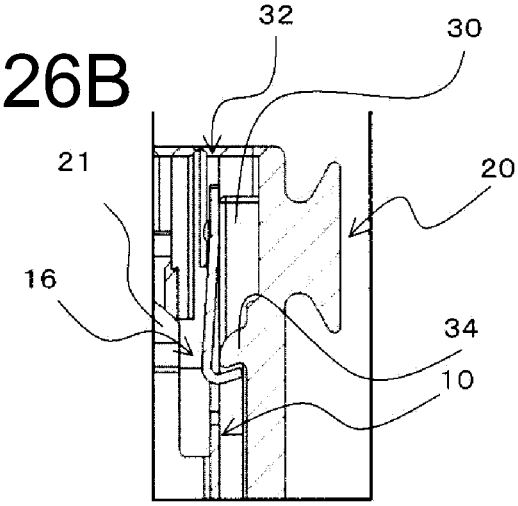
FIG. 26B is an enlarged view of part of FIG. 26A, that is, one holding-side lock portion and its neighborhood.

FIG. 24 shows a state before insertion of the pair of terminal fittings 10 into the respective terminal containing portions 30 of the socket main body 20. FIG. 25A shows a state immediately before the pair of terminal fittings 10 reach the lock positions, and FIG. 25B is an enlarged view of part of FIG. 25A, that is, one holding-side lock portion 34 and its neighborhood. FIG. 26A shows a state that the pair of terminal fittings 10 have reached the lock positions, and FIG. 26B is an enlarged view of part of FIG. 26A, that is, one holding-side lock portion 34 and its neighborhood.

First, the worker inserts the pair of terminal fittings 10 into the respective terminal containing portions 30 of the socket main body 20 (see FIG. 24 and FIGS. 25A and 25B).

Although the terminal-side lock projection 15 of each terminal fitting 10 projects to the side of the holding-side lock projection 34, it hardly comes into contact with portions other than the holding-side lock projection 34 because it is located in the guide space 31.

When the terminal fitting 10 reaches the vicinity of the lock position, the lock claw portion 15*b* of the terminal-side lock projection 15 comes into contact with the holding-side lock projection 34. Then the lock claw portion 15*b* climbs over the holding-side lock projection 34 because the cantilever spring portion 15*a* is bent elastically to the side of the insertion space 21.

When the terminal fitting 10 reaches the lock position, the terminal-side lock projection 16 is locked on the holding-side lock projection 34 (see FIGS. 26A and 26B). That is, the lock claw portion 15*b* climbs over the holding-side lock projection 34 and the cantilever spring portion 15*a* recovers, whereby the terminal-side lock projection 16 is locked on the holding-side lock projection 34.

At this time, the press-fit portions 13 are fitted into the press-fit grooves 33*a* of the terminal press-fit holding portions 32, respectively, and the terminal fitting 10 is held at the lock position in the terminal containing portion 30.

In this state, although locked on the holding-side lock projection 34, the terminal-side lock projection 16 is prone to be unlocked as a result of bending of the cantilever spring portion 15*a* to the side of the insertion space 21.

Subsequently, as shown in FIGS. 19A and 19B, the worker attaches the bulb 60 to the socket main body 20. As a result, each side portion 62*a* of the electrode unit 62 restricts elastic deformation of the terminal-side lock projection 16 in the direction in which it is unlocked from the holding-side lock projection 34.

Subsequently, as in the first embodiment, the worker attaches the light leakage prevention cover 50 to the socket main body 20. Finally, the worker attaches the translucent lens 40 to the assembly of the bulb socket 300 and the light leakage prevention cover 50.

In the locking structure 2 of terminal fittings and the bulb socket 300 according to the second embodiment of the present disclosure, as in the locking structure 1 of terminal fittings and the bulb socket 100 according to the first embodiment, the electrode unit 62 (connection counterpart) of the bulb 60 restricts elastic deformation of each terminal-side lock projection 16 (which is provided in the terminal fitting 10 so as to be capable of elastic deformation) in the direction in which it is unlocked from the holding-side lock projection 34. As a result, lowering of the forces for locking of the terminal fittings 10 can be prevented.

Although the locking structures 1 and 2 of terminal fittings according to the first and second embodiments of the present disclosure are such as to be incorporated in the bulb sockets 100 and 300 and the illumination devices 200 and 400, respectively, the present disclosure is not limited to such a case. The present disclosure may also be applied to locking structures of a terminal fitting(s) to be incorporated in other components or devices such as connectors.

Although the present disclosure made by the inventors has been described above in a specific manner using the embodiments of the present disclosure, the present disclosure is not limited to the above embodiments and various modifications are possible without departing from the spirit and scope of the present disclosure.

The present application is based on Japanese Patent Application No. 2013-255870 filed on Dec. 11, 2013, the contents of which are incorporated herein by reference.

What is claimed is:

1. A locking structure of a terminal fitting, comprising:

a terminal fitting; and a terminal containing portion that holds and contains the terminal fitting so that the terminal fitting is electrically connected to a connection counterpart in a condition that at least part of the connection counterpart is inserted in the terminal containing portion, wherein a first lock projection, which is elastically deformable and is provided on the terminal fitting, is locked on a second lock projection which is provided on the terminal containing portion; and wherein the at least part of the connection counterparts inserted in the terminal containing portion, directly contacts the first lock projection to restrict elastic deformation of the first lock projection in a direction in which the first lock projection is unlocked from the second lock projection.

2. The locking structure of the terminal fitting according to claim 1, wherein before insertion of the at least part of the connection counterpart into the terminal containing portion, the first lock projection is in an elastically neutral state and projects toward an insertion space in the terminal containing portion in which the at least part of the connection counterpart is to be inserted; and wherein when the at least part of the connection counterpart is inserted in the terminal containing portion, the at least part of the connection counterpart pushes the first lock projection which has been located in the insertion space toward the second lock projection so that the first lock projection is locked on the second lock projection.

3. The locking structure of the terminal fitting according to claim 1, wherein the terminal fitting has a press-fit portion which is held by the terminal containing portion; and wherein the terminal containing portion has a terminal press-fit holding portion which is press-fitted with the press-fit portion and thereby holds the terminal fitting at a lock position.

4. A bulb socket for supplying power to a bulb as a light source, comprising:

the locking structure of the terminal fitting according to claim 1, wherein the connection counterpart is the bulb; and wherein the terminal containing portion is provided in a socket main body of the bulb socket.

5. The locking structure of the terminal fitting according to claim 1, wherein the first lock projection is cantilevered such that a free end of the first lock projection extends from an area between curved contact portions of the terminal fitting to an attached end of the first lock projection which is attached to an area between press-fit portions of the terminal fitting; and wherein the press-fit portions and the first lock projection are positioned in a T-shape.

6. The locking structure of the terminal fitting according to claim 5, wherein each of the press-fit portions comprises one of a plurality of positioning projections projecting from respective surfaces of the press fit portions, and wherein each of the positioning projections projects into one of a plurality of terminal press-fit holding portions of the terminal containing portion, and is elastically held therein in either a locked state or an unlocked state of the first lock projection with respect to the second lock projection.

7. The locking structure of the terminal fitting according to claim 1, wherein when the first lock projection is in an elastically neutral state and the terminal fitting is fully inserted into the terminal containing portion the first lock projection does not contact the second lock projection; and wherein an insertion of the connection counterpart into the terminal containing portions elastically deforms the first lock projection to lock to the second lock projections.

* * * * *